US009763314B1

(12) United States Patent
Roper et al.

(10) Patent No.: US 9,763,314 B1
(45) Date of Patent: Sep. 12, 2017

(54) VAPOR CELLS WITH TRANSPARENT ALKALI SOURCE AND/OR SINK

(71) Applicant: HRL Laboratories, LLC, Malibu, CA (US)

(72) Inventors: Christopher S. Roper, Oak Park, CA (US); Matthew T. Rakher, Oxnard, CA (US); Logan D. Sorenson, Agoura Hills, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 15/203,298

(22) Filed: Jul. 6, 2016

Related U.S. Application Data

(60) Provisional application No. 62/202,525, filed on Aug. 7, 2015.

(51) Int. Cl.
*H05H 3/02* (2006.01)

(52) U.S. Cl.
CPC ..... *H05H 3/02* (2013.01)

(58) Field of Classification Search
USPC ..... 250/251, 425
See application file for complete search history.

(56) References Cited

U.S. PATENT DOCUMENTS

2014/0227548 A1* 8/2014 Myrick ..... C06B 45/30 428/570

* cited by examiner

*Primary Examiner* — Kiet T Nguyen
(74) *Attorney, Agent, or Firm* — O'Connor & Company

(57) ABSTRACT

In some variations, a vapor-cell system comprises: a vapor-cell region configured to allow at least one vapor-cell optical path into a vapor phase within the vapor-cell region; a first electrode disposed in contact with the vapor-cell region; a second electrode that is electrically isolated from the first electrode; and a transparent ion-conducting layer interposed between the first electrode and the second electrode, wherein the transparent ion-conducting layer is optically transparent over a selected optical band of electromagnetic wavelengths. Some embodiments provide a magneto-optical trap or atomic-cloud imaging apparatus, comprising: the disclosed vapor-cell system; a source of laser beams configured to provide three orthogonal vapor-cell optical paths through the vapor-cell gas phase, to trap or image a population of cold atoms; and a magnetic-field source configured to generate magnetic fields within the vapor-cell region. Methods of use are also disclosed herein.

26 Claims, 14 Drawing Sheets

VAPOR CELLS WITH TRANSPARENT ALKALI SOURCE AND/OR SINK

PRIORITY DATA

This patent application is a non-provisional application with priority to U.S. Provisional Patent App. No. 62/202,525, filed Aug. 7, 2015, which is hereby incorporated by reference herein.

STATEMENT REGARDING FEDERALLY SPONSORED RESEARCH OR DEVELOPMENT

This invention was made with Government support under Contract No. N66001-15-C-4027. The Government has certain rights in this invention.

FIELD OF THE INVENTION

The present invention generally relates to alkali and alkaline earth vapor cells, systems containing vapor cells, and methods of using vapor cells.

BACKGROUND OF THE INVENTION

Alkali vapor-cells have been used extensively since the 1960s in the study of light-atom interactions. Vapor-cell applications, both proposed and realized, include atomic clocks, communication system switches and buffers, single-photon generators and detectors, gas-phase sensors, nonlinear frequency generators, and precision spectroscopy instrumentation. However, most of these applications have only been created in laboratory settings.

Macroscale vapor cells are widely used in macroscale atomic clocks and as spectroscopy references. They are typically 10-100 $cm^3$ in volume, which is insignificant for $m^3$ scale atomic clocks, but far too large for chip-scale atomic clocks which are at most a few $cm^3$ in volume.

A key driver has thus been to reduce vapor-cell size. Traditional vapor-cell systems are large and, if they have thermal control, have many discrete components and consume a large amount of power. To realize the full potential of vapor-cell technologies, the vapor-cell systems need to be miniaturized.

Chip-scale atomic clocks and navigation systems require miniature vapor cells, typically containing cesium or rubidium, with narrow absorption peaks that are stable over time. Miniature vapor cells, and methods of filling them with alkali metals, have been described in the prior art. However, it has proven difficult to load a precise amount of alkali metal into a miniature vapor cell through the methods described in the literature. Miniature vapor cells have higher surface-area-to-volume ratios than macroscale vapor cells, and are more difficult to load than macroscale vapor cells.

It is difficult to load a precise amount of alkali metal into a miniature vapor cell. Furthermore, the amount of alkali vapor in a vapor cell changes over time as the vapor adsorbs, diffuses, and reacts with the walls. Alkali metal vapor pressure may be changed with a small set of known technologies (see Monroe et al., *Phys Rev Lett* 1990, 65, 1571; Scherer et al., *J Vac Sci & Tech A* 2012, 30; and Dugrain, *Review of Scientific Instruments*, vol. 85, no. 8, p. 083112, August 2014). However, these systems are slow, complex, and/or have a short longevity.

A number of patents and patent applications discuss miniature vapor cells and methods of filling them with alkali metals. See U.S. Pat. No. 8,624,682 for "Vapor cell atomic clock physics package"; U.S. Pat. No. 8,258,884 for "System for charging a vapor cell"; U.S. Pat. No. 5,192,921 for "Miniaturized atomic frequency standard"; WO 1997012298 for "A miniature atomic frequency standard"; and WO 2000043842 for "Atomic frequency standard."

Traditionally, alkali metals have been introduced into magneto-optical trap (MOT) vacuum systems via difficult-to-control manual preparation steps, such as manually crushing a sealed alkali-containing glass ampule inside a metal tube connected to the vacuum system via a control valve. See Wieman, American *Journal of Physics*, vol. 63, no. 4, p. 317, 1995. This approach requires external heating to replenish the alkali metal inside the vacuum system as needed (a slow process with little control over the amount of alkali metal delivered). The manual labor is non-ideal for automated systems or chip-scale devices.

An alternative exists in the now-common alkali metal dispensers, which are effectively an oven-controlled source of alkali metal, whereby the desired alkali metal is released by chemical reaction when a current is passed through the device. While this process automates the release of alkali metal into the vacuum system, it has difficulty in fabrication compatibility with chip-scale cold-atom devices. Further, the timescales required for generating (warm up) and sinking (pump down) alkali are typically on the order of seconds to minutes, and can vary greatly depending on the amount of alkali metal built up on the vacuum system walls.

A rapidly pulsed and cooled variant of the alkali metal dispenser has been developed to stabilize the residual Rb vapor pressure in 100 millisecond pump down time, but the device requires large-dimension Cu heat sinks and complicated thermal design (Dugrain, *Review of Scientific Instruments*, vol. 85, no. 8, p. 083112, August 2014) which may not easily translate to miniaturization.

Double MOTs wherein the first MOT is loaded at moderate vacuum and then an atom cloud is transferred to a second high-vacuum MOT have been implemented on the laboratory scale. Again, these systems require complicated dual-vacuum systems and controls as well as a transfer system to move the atom cloud from one MOT to the other, none of which is amenable to chip-scale integration.

Light-induced atomic desorption (LIAD) is a recent technique that solves some of the long pump-down times by only releasing a small amount of alkali using a desorption laser; however, this method requires preparing a special desorption target in the MOT vacuum chamber. The desorption laser can interfere with the trapping lasers of the MOT (see Anderson et al., *Physical Review A*, vol. 63, no. 2, January 2001). It also has yet to demonstrate suitable time constants below 1 second.

Thermoelectric stages can be used to regulate the overall temperature of the vapor cell, but this requires the addition of the thermoelectric stages, a temperature sensor and controller, and a significant amount of power (watts) to maintain the entire temperature of the cell at the correct temperature for MOT operation. The effectiveness of this approach will also depend on the overall size of the MOT cell and the efficiency of the thermoelectric stages, limiting the time constants at which the MOT can be loaded and the residual pressure stabilized.

Draper Laboratory has developed a solid-state ionic concept based on Cs conducting glass; see U.S. Pat. No. 8,999,123 and U.S. Patent App. Pub. No. 20110247942. However, the Draper technology suffers from two critical deficiencies. The Cs conducting glass has low ion conductivity. The implications of this are shown in Bernstein et al., "All solid state ion-conducting cesium source for atomic clocks," *Solid State Ionics* Volume 198, Issue 1, 19 Sep. 2011, Pages 47-49, in which >1000 V applied voltage and elevated temperature (~170° C.) are required to change the alkali content on time scales of ~100 seconds. Also the electrodes and ion-conductors are opaque, thus requiring transparent walls that lead to undesired adsorption, reaction, and/or diffusion of the alkali metal atoms and/or alkaline earth metal atoms.

What is instead desired is to work with much lower voltages (1-100V), lower temperatures (such as 25° C.), and much faster time response (such as 1 second). Response times <1 second are crucial because cold atom lifetime is typically <1 second. The excess atoms must therefore be removed from the vapor chamber on time scales <1 second in order to have any effect on the cold atom lifetime.

Atom chips use metal traces patterned via lithographic techniques to create magnetic fields involved in trapping populations of atoms. See U.S. Pat. No. 7,126,112 for "Cold atom system with atom chip wall"; Fortagh et al., *Rev. Mod. Phys.* 79, 235 (2007) Reichel et al., *Atom Chips*, Wiley, 2011; and Treutlein, *Coherent manipulation of ultracold atoms on atom chips*, Dissertation, Ludwig-Maximilians-University Munich, 2008. Atom chips typically are implemented as one wall of a vapor cell. Thus they suffer from the same issues—such as slow vapor pressure rate of change and loss of alkali vapor to the walls—as conventional vapor cells. The same benefits of a transparent alkali metal or alkaline earth metal source/sink to conventional vapor cells in which magnetic trapping fields are generated outside the vapor cell also apply to atoms chips for which magnetic fields are generated inside the vapor cell.

What is desired is a solution to the initial vapor-cell loading problem as well as the problem of a loss of alkali vapor over time. There is also a long-felt need for operation of cold-atom systems at elevated temperatures. It has long been desirable to operate cold-atoms systems at elevated temperature for precise timing and navigation applications, but the high equilibrium vapor pressure of the alkali metal vapors used at elevated temperatures leads to short (<1 millisecond) lifetimes of the cold atoms, which reduces the stability of the measurement by orders of magnitude.

SUMMARY OF THE INVENTION

The present invention addresses the aforementioned needs in the art, as will now be summarized and then further described in detail below.

In some variations, a vapor-cell system comprises:

a vapor-cell region configured to allow at least one vapor-cell optical path into a vapor-cell vapor phase within the vapor-cell region;

a first electrode disposed in contact with the vapor-cell region;

a second electrode that is electrically isolated from the first electrode; and a transparent ion-conducting layer interposed between the first electrode and the second electrode, wherein the transparent ion-conducting layer is at least 10% optically transparent over at least a 1 picometer wide optical band of electromagnetic wavelengths.

In some embodiments, the vapor-cell vapor phase contains a vapor-cell alkali metal, alkaline earth metal, or combination thereof. Optionally, the vapor-cell vapor phase further contains a vapor-cell buffer gas.

The vapor-cell region may be hermetically sealed. Alternatively, or additionally, the vapor-cell region may be in fluid communication with another system, such as a reservoir source of replacement alkali metal and/or alkaline earth metal.

In some embodiments, the transparent ion-conducting layer comprises alumina, β-alumina, β"-alumina, yttria-stabilized zirconia, NASICON, LISICON, KSICON, and combinations thereof. In certain embodiments, the transparent ion-conducting layer contains at least 50 wt % β-alumina, β"-alumina, or a combination of β-alumina and β"-alumina. The transparent ion-conducting layer may contain at least 90 wt % β"-alumina.

The transparent ion-conducting layer is preferably ionically conductive for at least one ionic species selected from the group consisting of $Rb^+$, $Cs^+$, $Na^+$, $K^+$, and $Sr^{2+}$. The transparent ion-conducting layer may be characterized by an ionic conductivity at 25° C. of about $10^{-7}$ S/cm or higher, such as about $10^{-5}$ S/cm or higher. In some embodiments, the transparent ion-conducting layer is initially and/or periodically ion-exchanged with an ionized version of an alkali metal or alkaline earth metal.

The optical band of electromagnetic wavelengths is preferably within ultraviolet, visible, and/or infrared bands. The transparent ion-conducting layer is at least 10%, 20%, 30%, 40%, 50%, 60%, 70%, 80%, or 90% optically transparent over an optical band with a bandwidth of at least about 1, 5, 10, 25, 50, 75, 100, 200, 300, 400, 500, 600, 700, 800, or 900 picometers, or at least about 1, 2, 3, 4, 5, 6, 7, 8, 9, or 10 nanometers.

In some embodiments, the optical band includes an unperturbed optical transition of an alkali atom or alkaline earth atom.

In some embodiments, the first electrode is at least 10%, 20%, 30%, 40%, 50%, 60%, 70%, 80%, or 90% optically transparent over the optical band (i.e. the same optical band over which the ion-conducting layer is at least partially transparent) or another optical band with a bandwidth of at least about 1, 5, 10, 25, 50, 75, 100, 200, 300, 400, 500, 600, 700, 800, or 900 picometers, or at least about 1, 2, 3, 4, 5, 6, 7, 8, 9, or 10 nanometers.

The first electrode may be fabricated from a material selected from the group consisting of indium tin oxide, antimony tin oxide, zinc tin oxide, and combinations thereof. The first electrode may be fabricated from metallic microwires, metallic nanowires, or metallic lithographically patterned networks. The first electrode may be fabricated from a graphene single layer, a graphene multi-layer, or a combination thereof. In some embodiments, the first electrode is fabricated from a sufficiently thin layer of electrically conductive material that is opaque at thicknesses greater than 10 microns.

In some embodiments, the second electrode is at least 10%, 20%, 30%, 40%, 50%, 60%, 70%, 80%, or 90% optically transparent over the optical band (i.e. the same optical band over which the ion-conducting layer is at least partially transparent and/or the same optical band over which the first electrode is at least partially transparent) or another optical band with a bandwidth of at least about 1, 5, 10, 25, 50, 75, 100, 200, 300, 400, 500, 600, 700, 800, or 900 picometers, or at least about 1, 2, 3, 4, 5, 6, 7, 8, 9, or 10 nanometers.

The second electrode may be fabricated from a material selected from the group consisting of indium tin oxide, antimony tin oxide, zinc tin oxide, and combinations thereof. The second electrode may be fabricated from metallic microwires, metallic nanowires, or metallic lithographically patterned networks. The second electrode may be fabricated from a graphene single layer, a graphene multilayer, or a combination thereof. In some embodiments, the second electrode is fabricated from a sufficiently thin layer of electrically conductive material that is opaque at thicknesses greater than 10 microns.

In preferred embodiments, the second electrode is not in contact with the vapor-cell region. In some embodiments, the second electrode is porous.

The vapor-cell system further includes an atom chip, in some embodiments of the invention. The atom chip may be disposed on a vapor-cell wall different from a wall that contains the first electrode. The atom chip may be heterogeneously integrated with a vapor-cell wall that contains the first electrode. Alternatively, or additionally, the atom chip is fabricated directly on a vapor-cell wall that contains the first electrode.

The vapor-cell system may be configured to allow three vapor-cell optical paths into the vapor-cell vapor phase. Preferably, the three vapor-cell optical paths are orthogonal. Other configurations can be employed, such as a pyramid configuration arising from three or more vapor-cell optical paths into the vapor-cell vapor phase.

Some variations of the invention provide a magneto-optical trap apparatus, the apparatus comprising:

a vapor-cell region configured to allow three orthogonal vapor-cell optical paths into a vapor-cell gas phase within the vapor-cell region;

a first electrode disposed in contact with the vapor-cell region;

a second electrode that is electrically isolated from the first electrode;

a transparent ion-conducting layer interposed between the first electrode and the second electrode, wherein the transparent ion-conducting layer is at least 10% optically transparent over at least a 1 picometer wide optical band of electromagnetic wavelengths;

a source of laser beams configured to provide the three orthogonal vapor-cell optical paths through the vapor-cell gas phase, to trap a population of cold atoms; and a magnetic-field source configured to generate magnetic fields within the vapor-cell region.

Some embodiments provide a magneto-optical trap apparatus, the apparatus comprising:

a vapor-cell region configured to allow three or more vapor-cell optical paths into a vapor-cell gas phase within the vapor-cell region;

a first electrode disposed in contact with the vapor-cell region;

a second electrode that is electrically isolated from the first electrode;

a transparent ion-conducting layer interposed between the first electrode and the second electrode, wherein the transparent ion-conducting layer is at least 10% optically transparent over at least a 1 picometer wide optical band of electromagnetic wavelengths;

a source of laser beams configured to provide the three or more vapor-cell optical paths through the vapor-cell gas phase, in a pyramid configuration, to trap a population of cold atoms; and a magnetic-field source configured to generate magnetic fields within the vapor-cell region.

Some variations of the invention provide an atomic-cloud imaging apparatus, the apparatus comprising:

a vapor-cell region configured to allow three orthogonal vapor-cell optical paths into a vapor-cell gas phase within the vapor-cell region;

a first electrode disposed in contact with the vapor-cell region;

a second electrode that is electrically isolated from the first electrode;

a transparent ion-conducting layer interposed between the first electrode and the second electrode, wherein the transparent ion-conducting layer is at least 10% optically transparent over at least a 1 picometer wide optical band of electromagnetic wavelengths;

a source of laser beams configured to provide the three orthogonal vapor-cell optical paths through the vapor-cell gas phase, to image a population of cold atoms; and a magnetic-field source configured to generate magnetic fields within the vapor-cell region.

Some variations of the invention provide an atomic-cloud imaging apparatus, the apparatus comprising:

a vapor-cell region configured to allow three or more vapor-cell optical paths into a vapor-cell gas phase within the vapor-cell region;

a first electrode disposed in contact with the vapor-cell region;

a second electrode that is electrically isolated from the first electrode;

a transparent ion-conducting layer interposed between the first electrode and the second electrode, wherein the transparent ion-conducting layer is at least 10% optically transparent over at least a 1 picometer wide optical band of electromagnetic wavelengths;

a source of laser beams configured to provide the three or more vapor-cell optical paths through the vapor-cell gas phase, in a pyramid configuration, to image a population of cold atoms; and a magnetic-field source configured to generate magnetic fields within the vapor-cell region.

DETAILED DESCRIPTION OF EMBODIMENTS OF THE INVENTION

Figure 1:
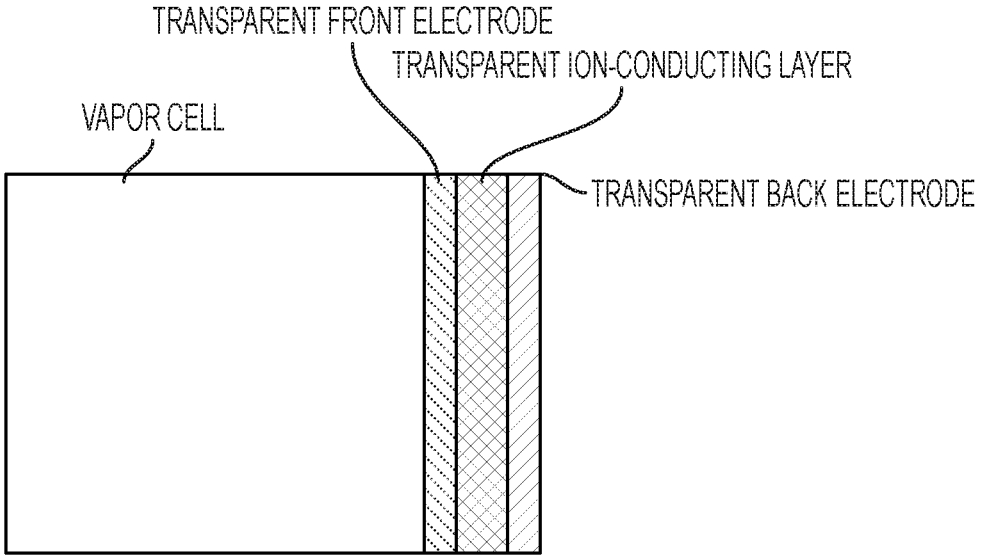
FIG. 1 is a schematic of an exemplary transparent alkali source/sink, in some embodiments.

The structures, systems, and methods of the present invention will be described in detail by reference to various non-limiting embodiments.

This description will enable one skilled in the art to make and use the invention, and it describes several embodiments, adaptations, variations, alternatives, and uses of the invention. These and other embodiments, features, and advantages of the present invention will become more apparent to those skilled in the art when taken with reference to the following detailed description of the invention in conjunction with the accompanying drawings.

As used in this specification and the appended claims, the singular forms "a," "an," and "the" include plural referents unless the context clearly indicates otherwise. Unless defined otherwise, all technical and scientific terms used herein have the same meaning as is commonly understood by one of ordinary skill in the art to which this invention belongs.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phrase "consisting of excludes any element, step, or ingredient not specified in the claim. When the phrase" consists of (or variations thereof) appears in a clause of the body of a claim, rather than immediately following the preamble, it limits only the element set forth in that clause; other elements are not excluded from the claim as a whole. As used herein, the phrase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of."

Some variations of this disclosure provide an alkali metal and/or alkaline earth metal vapor cell with a transparent ionic conductor and transparent electrodes which are used as sources and/or as sinks for the alkali metal and/or alkaline earth metal atoms, thus enabling electrical control over alkali and/or alkaline earth content of the vapor cell. The transparent nature of the device enables the ionic conductor to cover every exposed surface of the vapor cell and still permit optical access for laser cooling and measurement. Covering every exposed surface eliminates the uncontrollable alkali metal and/or alkaline earth metal adsorption on non-ion-conducting walls, thus enabling orders-of-magnitude faster control of alkali metal and/or alkaline earth metal vapor pressure.

For convenience, "alkali" or "alkali metal" may be used in this specification to refer to one or more alkali metals, one or more alkaline earth metals, or a combination thereof. Alkali metals include Li, Na, K, Cs, Rb, or Fr. Alkaline earth metal include Be, Mg, Ca, or Sr, Ba, and Ra.

Also, "source," "sink," "source and/or sink", "source/sink" or the like may be used herein to refer to a source of alkali metals and/or alkaline earth metals; a sink of alkali metals and/or alkaline earth metals; or a material or structure that acts as either a source or sink of alkali metals and/or alkaline earth metals, depending on local conditions (e.g., temperature, pressure, or electrical potential), concentrations of species, etc.

Some variations of the invention enable long population lifetimes of cold atoms, particularly in miniaturized atomic systems. Cold atoms (such as at temperatures of about 1 μK to about 1 K, typically from about 100 μK to about 1000 μK) are useful for precision timing and navigation applications. Cold atoms are typically formed from a subset of warmer atoms inside a vapor cell, e.g. through trapping and cooling in a magneto-optical trap (MOT). The time constant of the cold-atom population depends on the density of other atoms in the vapor cell because of collisional heating. For fast loading (i.e. short time constant on loading), it is desirable to have a high vapor density of atoms. However, for highly stable and highly precise measurement it is desirable to have the population of cold atoms last as long as possible; thus it is desirable to have a long time constant and low vapor density once the population of cold atoms has been cooled and trapped. In order to achieve both a fast loading time and long lifetime, it is desirable to actively control the vapor density in a vapor cell. It has now been discovered by the present inventors that ion conductors can be utilized to effectively control alkali vapor pressure in vapor cells.

This invention enables active, bidirectional control of alkali metal and alkaline earth metal vapor pressure within a vapor cell. The present invention overcomes the initial loading problem by allowing a vacuum to be sealed and using an ion-conducting layer as the alkali source. The present invention also overcomes the problem of a loss of alkali vapor over time because the walls to which alkali atoms are normally lost can be eliminated. Some embodiments enable low voltages (such as 1-100 V), low temperatures (such as 25° C.), and fast time responses (such as 1 second).

Advantages in some embodiments over previous art include, but are not limited to: bidirectional control through electrically reversible operation, thus serving as both a source and a sink; rapid (<1 second) operation through the use of superionic conductors, such as β-alumina or β"-alumina, which have high ionic conductivity; and transparent electrodes and ion-conductors.

In particular, transparent electrodes and ion conductors significantly reduce or eliminate wall pumping. "Wall pumping" refers to the collective effect of alkali metal and/or alkaline earth metal adsorption, reaction, and/or diffusion into, or out of, the walls of a vapor chamber. Wall pumping leads to the loss of alkali metal and alkaline earth metal atoms when a controlled alkali metal or alkaline earth metal source is being introduced in an attempt to raise the vapor pressure of a vapor cell—thus increasing the time required to raise the vapor pressure, decreasing the speed, and requiring more energy and material. In the reverse operation, wall pumping though desorption from the walls of the vapor chamber leads to an addition of alkali metal atoms and/or alkaline earth metal atoms when a sink of alkali metal atoms and/or alkaline earth metal atoms would otherwise reduce the vapor pressure of a vapor cell—thus increasing the time required to lower the vapor pressure, decreasing the speed, and requiring more energy.

Vapor chamber walls need to be transparent to allow optical access to the alkali metal atoms and/or alkaline earth metal atoms inside for laser cooling and measurement purposes. Typically, the majority of the wall area is transparent. Also typically, alkali sources and sinks are opaque. According to the principles of this invention, the alkali sources and sinks can cover the entire vapor cell inner wall—thus minimizing or eliminating undesirable wall pumping, increasing the rate of vapor pressure change, decreasing the time to change vapor pressure, decreasing the amount of energy required to change the vapor pressure, and decreasing the amount of material required to change the vapor pressure.

In some variations, a transparent alkali source and/or sink consists of the following elements: a vapor chamber volume; an ionic conductor; at least one first transparent electrode; and at least one second transparent electrode.

Within the vapor chamber volume, the vapor chamber contains an atomic vapor, preferably that of an alkali metal or an alkaline earth metal. Optionally, the atomic vapor is isotopically enriched or purified. When the alkali or alkaline earth metal is isotopically enriched, the relative abundance of the isotopes of a given element are altered, thus producing a form of the element that has been enriched in one particular isotope and depleted in its other isotopic forms. The alkali or alkaline earth metal may be isotopically pure, which means it is composed entirely of one isotope of the selected alkali or alkaline earth metal.

In some embodiments, the vapor chamber contains nothing but the atomic vapor as a rarefied gas, i.e. the vapor chamber is under partial vacuum.

In other embodiments, the vapor chamber contains additional gases in addition to the atomic vapor. Additional gases may be selected from $N_2$, $CH_4$, He, Ar, Ne, Xe, $NH_3$, $CO_2$, $H_2O$, $H_2$, or mixtures of these or other molecules, for example. Non-metal atoms (e.g., elemental H, N, or O) may also be used as additional gases. The other gas or gases may be used as a buffer gas or as spin exchange gas, for example. Optionally, the other gas or gases may be isotopically enriched or purified. Any additional gas is preferably not reactive with the alkali or alkaline earth metal.

The vapor chamber may be hermetically sealed. The vapor chamber may also be configured in fluid communication with a larger system, which may or may not be collectively (with the vapor chamber) hermetically sealed. The larger system, for example, could be part of a high-vacuum system containing pumps, pressure/vacuum gauges, atom dispensers, getters, getter pumps, getter sources, pill sources, etc.

One or more walls of the vapor chamber volume are at least partially transparent, and preferably substantially transparent, at relevant wavelengths such that there is an optical path through the vapor cell volume. It is preferred that the optical path go through the vapor cell, that is, from one wall to another wall. In some embodiments, a laser beam may enter the vapor cell, reflect off a mirrored surface inside the cell, and leave the cell through the same side that it entered.

Walls enclose the vapor-cell region, sealing it from the ambient environment. The walls may be fabricated from silicon, $SiO_2$, fused silica, quartz, pyrex, metals, dielectrics, or a combination thereof, for example. At least one of the walls includes a substantially transparent portion such that there is an optical path through the vapor-cell region. A wall can be made transparent either by fabricating from an optically transparent material, or by including an optical window in a part of the wall.

The vapor chamber volume may be configured to allow three orthogonal optical paths to facilitate the formation of a magneto-optical trap (MOT) and for atomic cloud imaging.

The ionic conductor (i.e., ion-conducting layer) is at least partially transparent at one or more wavelength bands. For typical cooling and trapping, this transparency bandwidth could be as small as about 1 picometer and be more than sufficient. More exotic applications may require 1 nm, 10 nm, 100 nm or larger. For example, trapping rubidium-87 ($^{87}Rb$) using 1064 nm laser light may require a ~300 nm bandwidth or multiple transparency bandwidths.

The wavelength bands may be in the infrared, visible, or ultraviolet ranges. In a particular embodiment, the optical band includes an electromagnetic wavelength of about 780 nm. Optionally, the transparency band includes a frequency for atomic cloud imaging. Optionally, the transparency band includes a frequency for laser cooling.

The optical transmission in the transparency band is preferably at least 10%, at more preferably at least 50%, and most preferably at least 90%. In various embodiments, the transparent ion-conducting layer is characterized by an optical transmission (transparency) of at least 10%, 20%, 30%, 40%, 50%, 60%, 70%, 80%, 90%, or 95% over the selected optical band(s).

The transparency may be achieved by making the ion conductor (i.e., ion-conducting layer) sufficiently thin, such as from about 1 nanometer to about 100 microns. One method of making the ion conductor sufficiently thin is chemical mechanical polishing, followed by appropriate bakeout of the ion-conductor material at suitably high temperature and/or suitably long duration. Another method of making the ion conductor sufficiently thin is to deposit it conformally on the walls of a preformed transparent vacuum chamber using a deposition process, such as solution deposition or deposition followed by calcination, of a hydrated alumina gel for example.

In some embodiments, less than every exposed surface is covered by the transparent ion-conducting layer. For example, with respect to available (to alkali atoms) surface area, at least about 50%, 60%, 70%, 80%, 90%, 95%, 99%, 99.9%, or 100% of the available surface area is covered and thus not susceptible to alkali metal or alkaline earth metal wall pumping.

The ion-conducting layer preferably has high ionic conductivity for an ionic species. The ionic species is preferably an alkali metal or alkaline earth metal ion, such as (but not limited to) one or more of $Na^+$, $K^+$, $Rb^+$, $Cs^+$, or $Sr^{2+}$. The ionic conductivity, measured at 25° C., is preferably about $10^{-7}$ S/cm or higher, more preferably about $10^{-5}$ S/cm or higher. In various embodiments, the ionic conductivity of the ion-conducting layer at 25° C. is about $10^{-8}$ S/cm, $10^{-7}$ S/cm, $10^{-6}$ S/cm, $10^{-5}$ S/cm, $10^{-4}$ S/cm, $10^{-3}$ S/cm, or $10^{-2}$ S/cm.

It is desirable to have an ionic conductor with a high permittivity. This will lead to a higher pseudocapacitance and thus lower actuation voltages for a given quantity of alkali atoms.

The ionic conductor is preferably a solid electrolyte, in some embodiments. For example, the ionic conductor may be a large fraction (>50% by weight) β-alumina, β"-alumina, or a combination of β-alumina and β"-alumina. Beta-alumina solid electrolyte (BASE) is a fast ion-conductor material used as a membrane in several types of electrochemical cells. β-alumina and β"-alumina are good conductors of their mobile ions yet allows negligible non-ionic (i.e., electronic) conductivity. β"-alumina is a hard polycrystalline or monocrystalline ceramic which, when prepared as an electrolyte, is complexed with a mobile ion, such as $Na^+$, $K^+$, $Li^+$, or an ionic version of the alkali or alkaline earth metal. Other possible solid electrolyte materials include yttria-stabilized zirconia, NASICON, LISICON, KSICON, and combinations thereof. It is desirable that hygroscopic ionic conductors are not in contact with ambient or humid air.

The first transparent electrode is in contact with both the ionic conductor and the vapor chamber volume. Both the first electrode and the ionic conductor may form part of the inner walls of the vapor chamber. The first transparent electrode is at least partially transparent at one or more wavelength bands, similar to the transparency for the ion-conducting layer, described above. The wavelength bands for the first transparent electrode may be in the infrared, visible, or ultraviolet ranges. Optionally, the transparency band includes a frequency for atomic cloud imaging. Optionally, the transparency band includes a frequency for laser cooling.

The optical transmission in the transparency band(s) is preferably at least 10%, at more preferably at least 50%, and most preferably at least 90%. In various embodiments, the first transparent electrode is characterized by an optical transmission (transparency) of at least 10%, 20%, 30%, 40%, 50%, 60%, 70%, 80%, 90%, or 95% over the selected optical band(s).

Exemplary first transparent electrode structures include transparent bulk materials and opaque bulk materials that cover a small fraction of the area so as to yield transparency. Transparent bulk materials include indium tin oxide (ITO), antimony tin oxide (ATO), zinc tin oxide (ZTO), and combinations of these materials, for example. Opaque bulk structures that cover a small fraction of the area so as to yield transparency include, but are not limited to, metallic microwire and nanowire networks and lithographically patterned metallic networks. Another electrode option is a sufficiently thin conductive film such as TiN or metallic films. Such films could be deposited, such as with atomic layer deposition or evaporation. Another electrode option is a conductive graphene monolayer or graphene multilayer.

The first electrode is preferably designed to have a large amount of three-phase contact length or interfacial contact area. The three phases are electrode, ionic conductor, and atomic vapor. Configurations that may accomplish high three-phase contact include a high-density mesh or grid pattern, a porous material with an open porosity, a high-density parallel line pattern, or a nanowire array, for example.

The first transparent electrode preferably does not chemically interact with the ionic species. That is, the first transparent electrode preferably does not form an intermetallic phase and preferably does not chemically react with the ionic species. Also, the first transparent electrode preferably does not chemically interact with the ionic conductor; the electrode preferably does not form mobile ions within the ionic conductor.

Exemplary electrode materials include Pt, Ni, Mo, or W, in certain embodiments. The electrode may include more than one layer, such as a Ti adhesion layer and a Pt layer. It is desirable that, when applied, an electrical potential does not vary considerably (e.g. <0.1 V difference) across the electrode surface. The electrode thickness is selected, in some embodiments, as a function of the electrode material resistivity and the expected ionic current through the ionic conductor.

The second transparent electrode is in contact with the ionic conductor. Preferably, the second transparent electrode is not in physical contact with the vapor chamber volume. The second transparent electrode is not in electrical contact with the first transparent electrode.

The second transparent electrode is at least partially transparent at one or more wavelength bands, similar to the transparency for the first transparent electrode, described above. The wavelength bands for the second transparent electrode may be in the infrared, visible, or ultraviolet ranges. Optionally, the transparency band includes a frequency for atomic cloud imaging. Optionally, the transparency band includes a frequency for laser cooling.

The optical transmission in the transparency band(s) is preferably at least 10%, at more preferably at least 50%, and most preferably at least 90%. In various embodiments, the second transparent electrode is characterized by an optical transmission (transparency) of at least 10%, 20%, 30%, 40%, 50%, 60%, 70%, 80%, 90%, or 95% over the selected optical band(s).

Exemplary second transparent electrode structures include transparent bulk materials and opaque bulk materials that cover a small fraction of the area so as to yield transparency. Transparent bulk materials include indium tin oxide (ITO), antimony tin oxide (ATO), zinc tin oxide (ZTO), and combinations of these materials, for example. Opaque bulk structures that cover a small fraction of the area so as to yield transparency include metallic microwire and nanowire networks and lithographically patterned metallic networks.

Exemplary second electrode materials include Pt, Ni, Mo, or W, in certain embodiments. The second electrode may include more than one layer, such as a Ti adhesion layer and a Pt layer. It is desirable that, when applied, an electrical potential does not vary considerably (e.g. <0.1 V difference) across the second electrode surface. The second electrode thickness is selected, in some embodiments, as a function of the electrode material resistivity and the expected ionic current through the ionic conductor. The second electrode may be solid or may be porous.

The optical band of electromagnetic wavelengths is preferably within ultraviolet, visible, and/or infrared bands. The transparent ion-conducting layer is at least 10%, 20%, 30%, 40%, 50%, 60%, 70%, 80%, or 90% optically transparent over an optical band with a bandwidth of at least about 1, 5, 10, 25, 50, 75, 100, 200, 300, 400, 500, 600, 700, 800, or 900 picometers, or at least about 1, 2, 3, 4, 5, 6, 7, 8, 9, or 10 nanometers. In some embodiments, the optical band includes an unperturbed optical transition of an alkali atom or alkaline earth atom.

In some embodiments, the first electrode is at least 10%, 20%, 30%, 40%, 50%, 60%, 70%, 80%, or 90% optically transparent over the optical band (i.e. the same optical band over which the ion-conducting layer is at least partially transparent) or another optical band with a bandwidth of at least about 1, 5, 10, 25, 50, 75, 100, 200, 300, 400, 500, 600, 700, 800, or 900 picometers, or at least about 1, 2, 3, 4, 5, 6, 7, 8, 9, or 10 nanometers.

In some embodiments, the second electrode is at least 10%, 20%, 30%, 40%, 50%, 60%, 70%, 80%, or 90% optically transparent over the optical band (i.e. the same optical band over which the ion-conducting layer is at least partially transparent and/or the same optical band over which the first electrode is at least partially transparent) or another optical band with a bandwidth of at least about 1, 5, 10, 25, 50, 75, 100, 200, 300, 400, 500, 600, 700, 800, or 900 picometers, or at least about 1, 2, 3, 4, 5, 6, 7, 8, 9, or 10 nanometers.

A number of variations of the system and device are possible. Several variations will now be described, without limiting the scope of the invention.

The vapor cell may or may not be situated inside a magnetic field. For example, coils of wire driven in an anti-Helmholtz configuration surrounding the vapor cell may be used to generate the magnetic fields required for an atom trap. Other magnetic-field sources (such as magnets or materials capable of generating magnetic flux) may be utilized to generate magnetic fields within the vapor-cell region.

The vapor cell may or may not be contained within an oven. The purpose of the oven may be to control the temperature of the vapor cell at a temperature above the ambient temperature. In principle, the vapor cell may be contained within any sort of temperature-controlled system, for heating or cooling the vapor cell.

The vapor cell, or system containing the vapor cell, may include one or more heaters to increase temperature and thus increase the ionic conductivity of the ion-conducting layer. The higher temperature may be used to temporarily, periodically, or constantly increase the ionic conductivity of the ion-conducting layer. The heater is preferably a resistive heater, but may also be a thermoelectric heater, for example. In some embodiments, the heater is patterned directly on the ionic conductor. Alternatively, or additionally, the heater may be patterned on another part of the device or simply attached to a part of the device.

Each electrode is typically connected to an electrical lead fabricated from an electrically conductive material. A lead is an electrical connection consisting of a length of wire, metal pad, metal trace, or other electrically conductive structure. Leads are used to transfer power and may also provide physical support and potentially provide a heat sink. In some embodiments, a device is provided without such leads, which may be added at a later time, before use.

The device may be implemented at a wide variety of length scales. The length scale may be characterized by the cube root of the vapor chamber volume. In various embodiments, the length scale can vary from 10 m down to 1 nm. Typically, the length scale is about 10 mm to 1 m for macroscale atomic timing and navigation systems, and about 10 microns to 10 mm for chip-scale atomic timing and navigation systems. Chip-scale devices are preferably constructed using microfabrication techniques, including some or all of lithography, shadow-masking, evaporation, sputtering, wafer bonding, die bonding, anodic bonding, glass frit bonding, metal-metal bonding, and etching.

Multiple ionic conductors, each with their own electrodes, may be present in a single device. The multiple front electrodes may or may not be electrically connected through electrical leads or electrical traces. Likewise, the multiple back electrodes may or may not be electrically connected through electrical leads or electrical traces.

Multiple sets of front electrodes, ion conductors, and back electrodes may be present in the system. In some embodiments, two or more front electrodes are employed. In these or other embodiments, two or more back electrodes are employed. In any of these embodiments, or other embodiments, two or more ion conductors are employed.

In some embodiments, a first front electrode, first ion conductor, and first back electrode are all at least partially transparent (e.g., at least 10%, preferably at least 50%, and more preferably at least 90% transparent). When a second front electrode, second ion conductor, and second back electrode are present, each of these structures is optionally at least partially transparent, or opaque. The second ion conductor (when present) may be at least partially transparent, while both of the second front electrode (when present) and/or the second back electrode (when present) are opaque. Many combinations are possible.

One or more of the back electrodes may be in contact with a reservoir volume. The reservoir volume may be hermetically sealed or may be in fluid communication with a larger system. The larger system, for example, could be part of a high-vacuum system containing pumps, pressure/vacuum gauges, atom dispensers, getters, getter pumps, getter sources, pill sources, etc. The reservoir volume may contain alkali metal or alkaline earth metal in a vapor phase, a solid phase, and/or a liquid phase.

U.S. patent application Ser. No. 14/879,510 entitled "VAPOR CELLS WITH ELECTRICAL CONTROL OF VAPOR PRESSURE, AND METHODS OF USING THE VAPOR CELLS" and filed Oct. 9, 2015 (commonly owned with the present patent application) is hereby incorporated by reference herein for its disclosure about reservoir regions that may be utilized in the vapor-cell system of this invention, in certain embodiments.

In some embodiments, one or more of the back electrodes contains an alternate source of replacement ions (or replacement atoms) for the ion conductor. The alternate source of replacement ions could be a metal (e.g. silver), an ion-containing species (e.g. a salt), an intercalated compound (e.g. Rb intercalated into graphite), an intermetallic compound (e.g. gold-rubidium intermetallic), or a solid or liquid elemental form of alkali metal or alkaline earth metal.

In the case of a solid or liquid alkali-metal back electrode, the alkali metal may be capped with a non-reacting layer such as Pt to seal in the alkali metal and prevent corrosion and/or oxidation.

When a potential is applied across a front electrode and a paired back electrode which contains an alternate source of replacement ions or atoms, such that the front electrode is at a lower electrical potential than the back electrode, alkali ions or alkaline earth metal ions in the ion conductor between the electrodes will migrate (i.e. conduct) towards the front electrode. They will be replaced by the replacement ions/atoms at the back electrode. This prevents the depletion of ions in the ion conductor near the back electrode, thus preventing the charging of a pseudocapacitor which would otherwise require increasing electrical potential to transport more ions. However, this does contaminate the ion conductor with the make-up replacement ions.

One or more of the back electrodes may be configured to enable an electrochemical capacitor. It is preferable to configure such back electrodes such that they contact as large an area (of the ionic conductor) as possible, to increase the electrochemical pseudocapacitance. For instance, the ionic conductor may have a roughened, etched, trenched, crenulated, or ridged back surface to increase the contact area between itself and the back electrode(s).

The vapor cell may also contain an atom chip for intra-system generation of magnetic fields for microtraps. There are many variations of this design.

In some embodiments, an atom chip is disposed on a different vapor cell face from a bidirectional solid-state ionic capacitor alkali source.

In some embodiments, an atom chip is fabricated on a base chip that is heterogeneously integrated with the transparent alkali source and/or sink, on the same vapor cell face. The atom chip may be closer to the vapor cell volume than the ionic conductor, in which case the alkali atoms can pass around the edges of the atom chip or through one of more (optional) holes in the atom chip. The ionic conductor may be closer to the vapor cell than the atom chip, in which case the trapped population of cold atoms can be situated above the ionic conductor. Note that the atom chip and the ionic conductor need not be the same size.

In some embodiments, an atom chip is fabricated directly on the transparent alkali source and/or sink. The atom chip traces that generate the magnetic fields for microtraps will usually be adjacent to the top electrode traces in this case. The atom chip traces that generate the magnetic fields for microtraps may be separated from the ionic conductor by a material which is both an electronic insulator and an ionic insulator (e.g., certain glass materials).

Reference is now made to the accompanying drawings, which should not be construed as limiting the invention in any way, but will serve to illustrate various embodiments.

FIG. 1 is a schematic of an exemplary transparent alkali source/sink, in some embodiments. The back electrode may contain a source of replacement ions. In some embodiments, the back electrode is configured to operate as an electrochemical pseudocapacitor. The device shown in FIG. 1 could be used as an alkali source or as both a source and a sink.

Figure 2A:
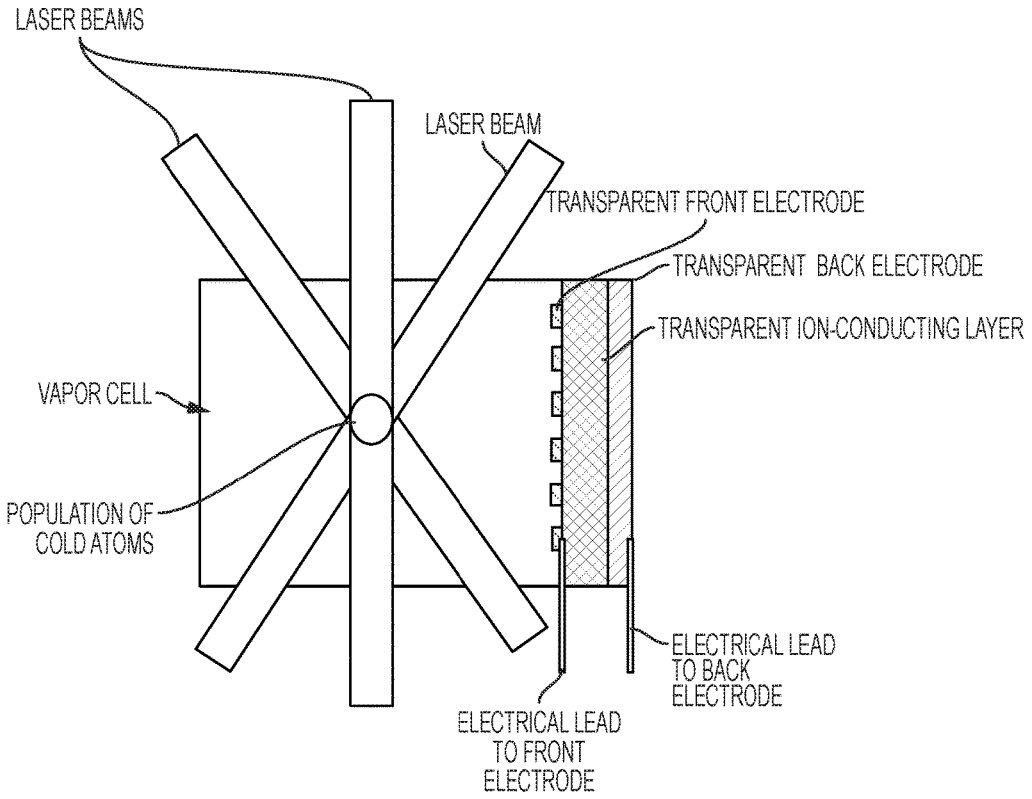
FIG. 2A is a schematic of a variation on a transparent alkali source/sink, showing laser beams traversing three optical paths in the vapor cell and trapping a population of cold atoms.

FIG. 2A is a schematic of a variation on a transparent alkali source/sink, showing laser beams traversing three optical paths in the vapor cell and trapping a population of cold atoms. In some embodiments, the three optical paths are orthogonal. A magnetic field source and magnetic field lines, which also play a role in the trapping of atoms, are not depicted in this sketch.

Figure 2B:
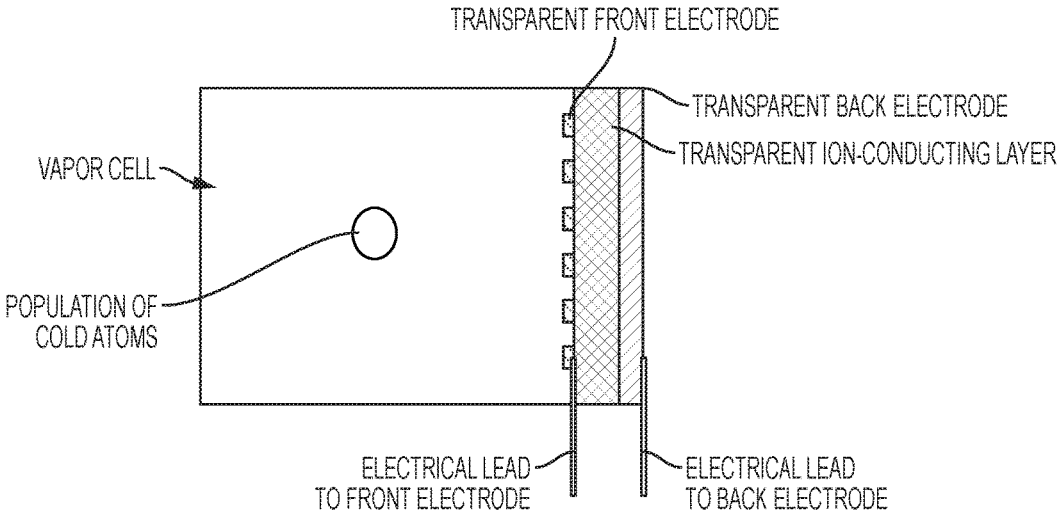
FIG. 2B is a schematic of a variation on a transparent alkali source/sink, equivalent to FIG. 2A except that the laser beams are not shown.

FIG. 2B is a schematic of a variation on a transparent alkali source/sink, equivalent to FIG. 2A except that the laser beams are not shown. It shall be understood that laser beams may or may not be present in any vapor cell described in this specification. That is, a source of laser beams may be present but not operating, in which case no laser beams will enter or be present within the vapor-cell region. Or a vapor cell may be provided without a source of laser beams, which source may be added at a later time, prior to operation of the vapor-cell system. In any event, the laser beams can be omitted from the drawing for clarity, it being understood that laser beams may be present. The remaining drawings (FIGS. 3-13) do not explicitly depict laser beams or optical paths, it being understood that that laser beams may or may not be actually present, analogous to FIGS. 2A/2B.

Figure 3:
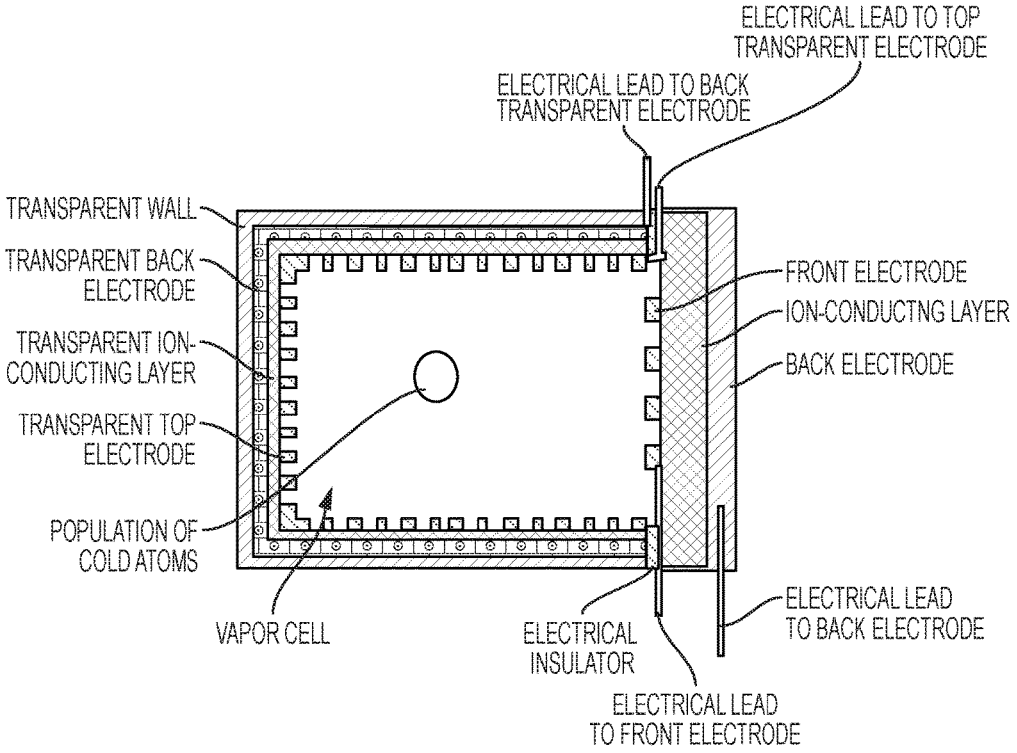
FIG. 3 is a schematic of a variation on a transparent alkali source/sink, in which there are two alkali source/sinks covering the entire inner wall of the vapor cell.

FIG. 3 is a schematic of a variation on a transparent alkali source/sink. In this variation, there are two alkali source/sinks. One source/sink is transparent (collectively, the transparent wall, transparent back electrode, transparent ion-conducting layer, and transparent top electrode, on the left-hand side of FIG. 3) and the other source/sink may or may not be transparent (collectively, the front electrode, ion-conducting layer, and back electrode, on the right-hand side of FIG. 3). The alkali source/sinks cover almost the entire inner wall of the vapor cell, leaving little to no area for adsorption and/or reaction on non-alkali source/sink surfaces. The transparent source/sink is used to control wall pumping, while the other source/sink is used as the main source of alkali atoms.

Figure 4:
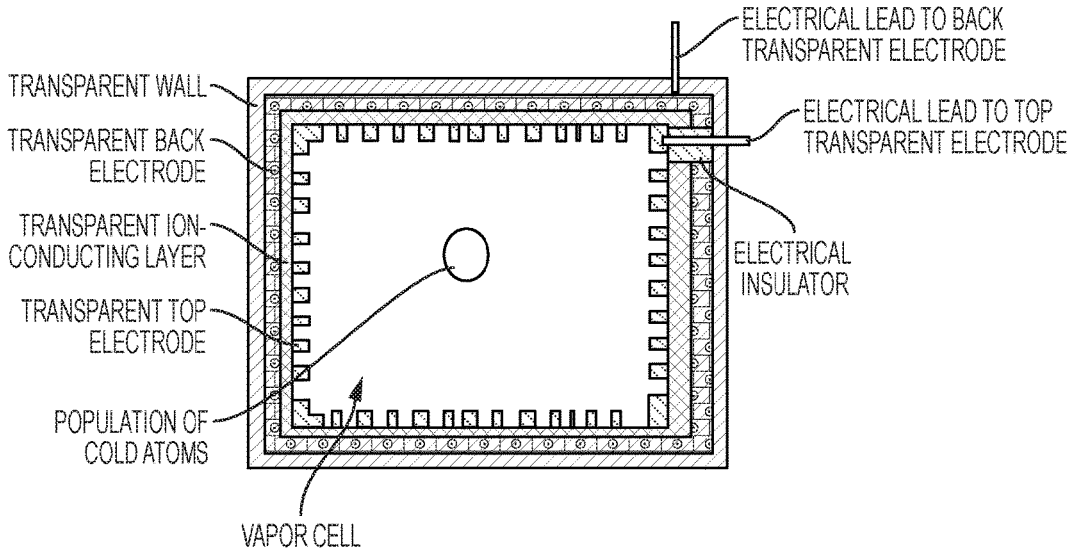
FIG. 4 is a schematic of a variation on a transparent alkali source/sink, in which there is one transparent alkali source/sink which covers the entire inner wall of the vapor cell.

FIG. 4 is a schematic of a variation on a transparent alkali source/sink. In this variation, there is one transparent alkali source/sink (collectively, the transparent wall, transparent back electrode, transparent ion-conducting layer, and transparent top electrode of FIG. 4) which covers almost the entire inner wall of the vapor cell, leaving little to no area for adsorption and/or reaction on non-alkali source/sink surfaces. The transparent source/sink is used to both control wall pumping and as the main source of alkali atoms.

Figure 5:
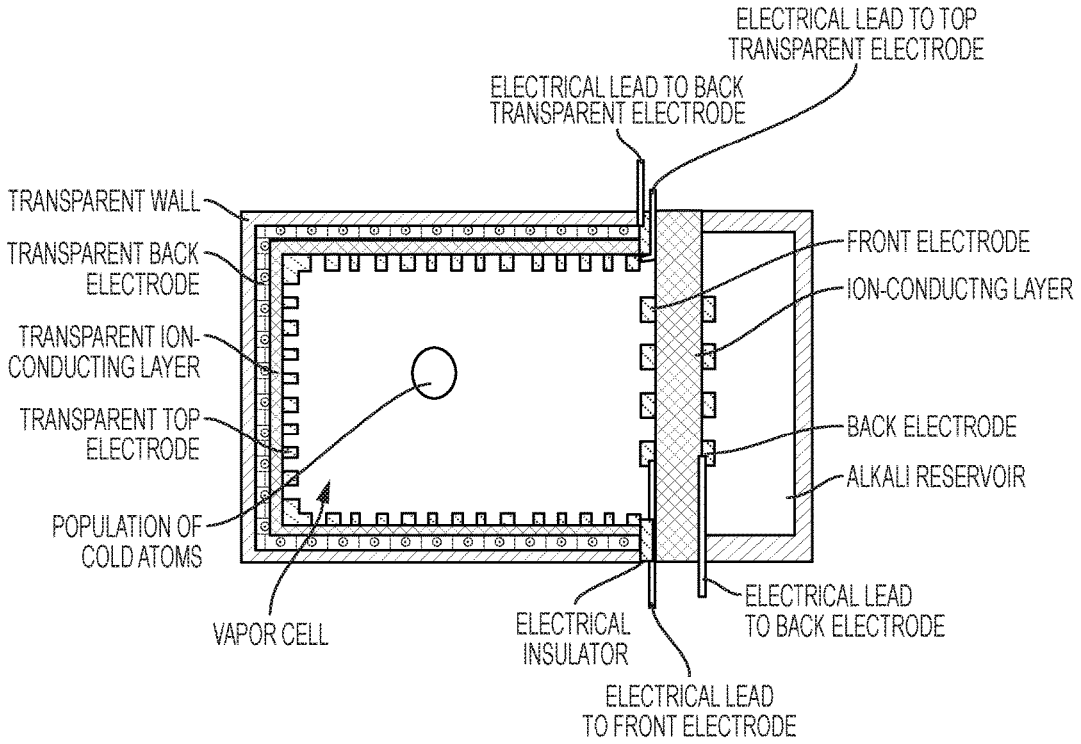
FIG. 5 is a schematic of a variation on a transparent alkali source/sink, in which there are two alkali source/sinks covering the entire inner wall of the vapor cell.

FIG. 5 is a schematic of a variation on a transparent alkali source/sink. In this variation, there are two alkali source/sinks. One source/sink is transparent (collectively, the transparent wall, transparent back electrode, transparent ion-conducting layer, and transparent top electrode of FIG. 5) and a second source/sink may or may not be transparent (collectively, the front electrode, ion-conducting layer, and back electrode of FIG. 5). The alkali source/sinks cover almost the entire inner wall of the vapor cell, leaving little to no area for adsorption and/or reaction on non-alkali source/sink surfaces. The second alkali source/sink is connected to an alkali reservoir to provide additional alkali atoms to draw from. The transparent source/sink is preferably used to control wall pumping, while the second source/sink connected to the alkali reservoir is preferably used as the main source of alkali atoms.

Figure 6:
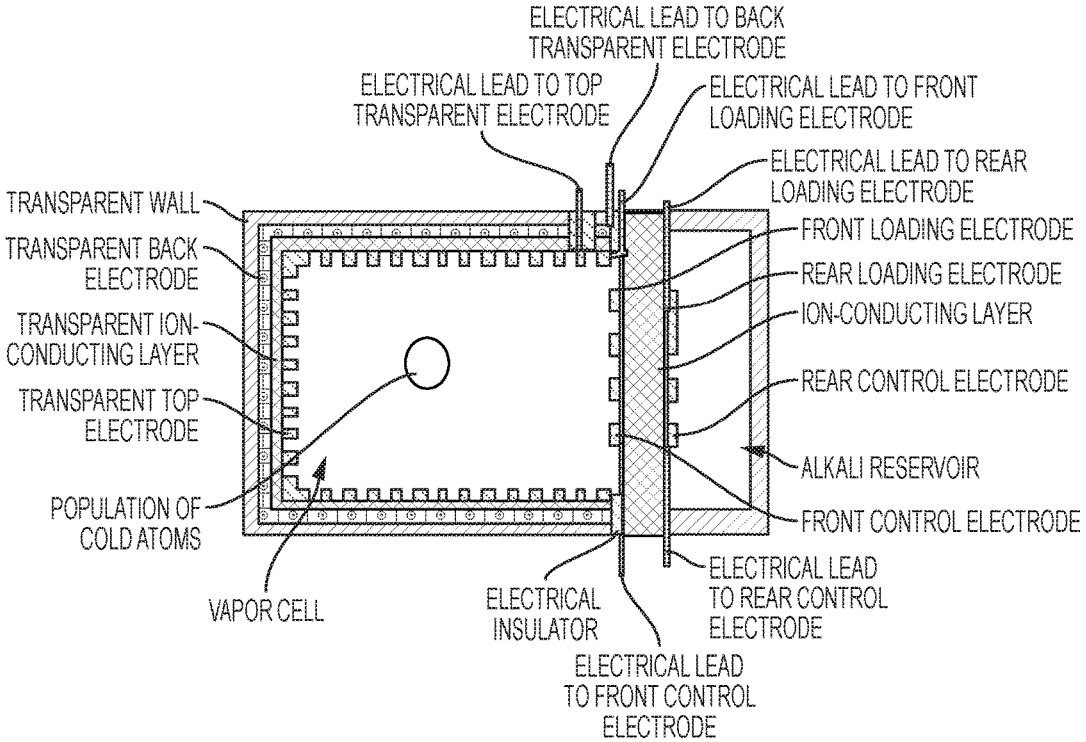
FIG. 6 is a schematic of a variation on a transparent alkali source/sink, in which there are two alkali source/sinks covering the entire inner wall of the vapor cell; and multiple electrodes on each side of an ion-conducting layer separating the vapor cell from an alkali reservoir.

FIG. 6 is a schematic of a variation on a transparent alkali source/sink. In this variation, there are two alkali source/sinks. One source/sink is transparent and the second source/sink may or may not be transparent. The alkali source/sinks cover almost the entire inner wall of the vapor cell, leaving little to no area for adsorption and/or reaction on non-alkali source/sink surfaces. The second alkali source/sink is connected to an alkali reservoir to hold a population of reserve alkali atoms. Furthermore, there are multiple electrodes on each side of an ion-conducting layer separating the vapor cell from the alkali reservoir. This enables one set of electrodes to draw alkali atoms from the ion-conducting layer as an initial source and another set of electrodes to move alkali atoms between the vapor cell and the reservoir to control vapor pressure.

Figure 7:
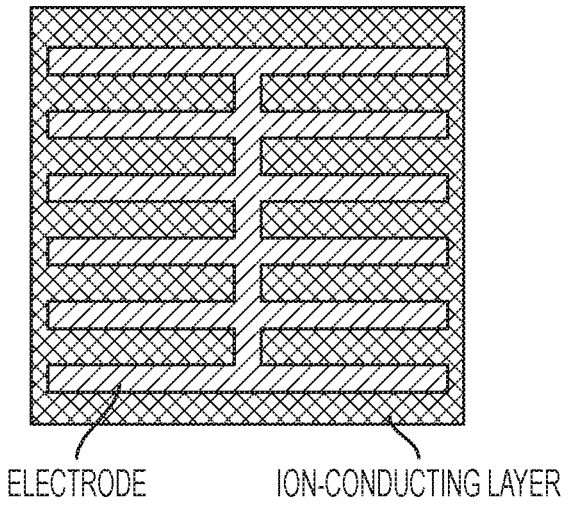
FIG. 7 is a schematic of an electrode configured on an ion-conducting layer, in some embodiments.

FIG. 7 is a schematic of an electrode configured on an ion-conducting layer, in some embodiments.

Figure 8:
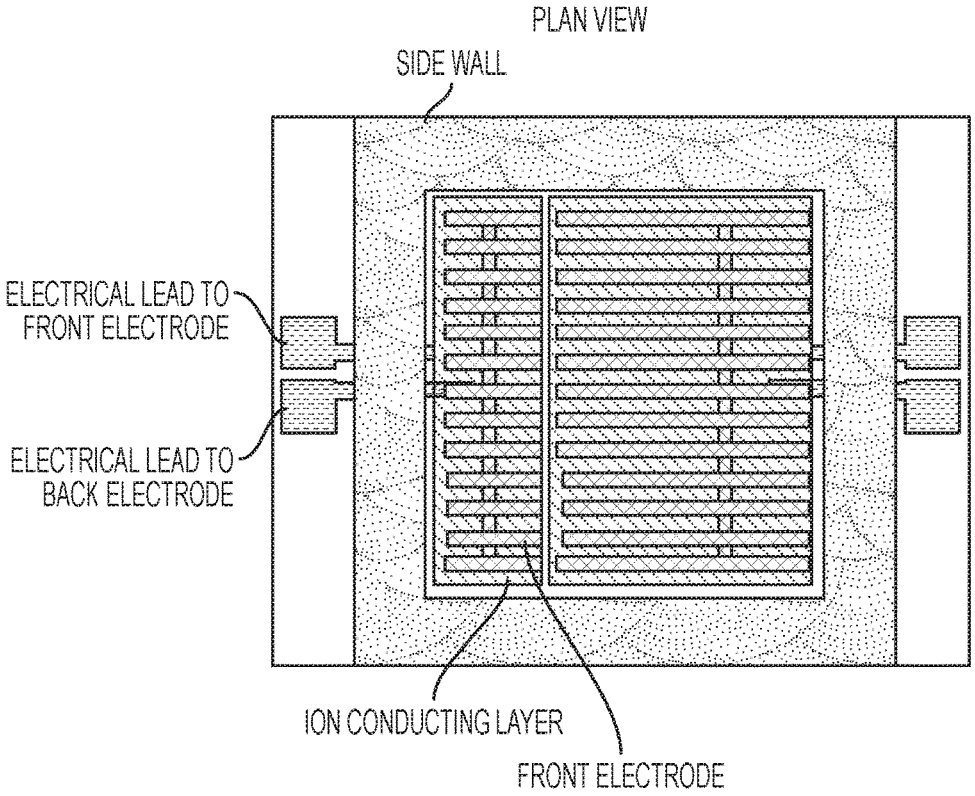
FIG. 8 is a plan-view schematic of a chip-scale variation of a transparent alkali source/sink, in some embodiments.

FIG. 8 is a plan-view schematic of a chip-scale variation of a transparent alkali source/sink, in some embodiments.

Figure 9:
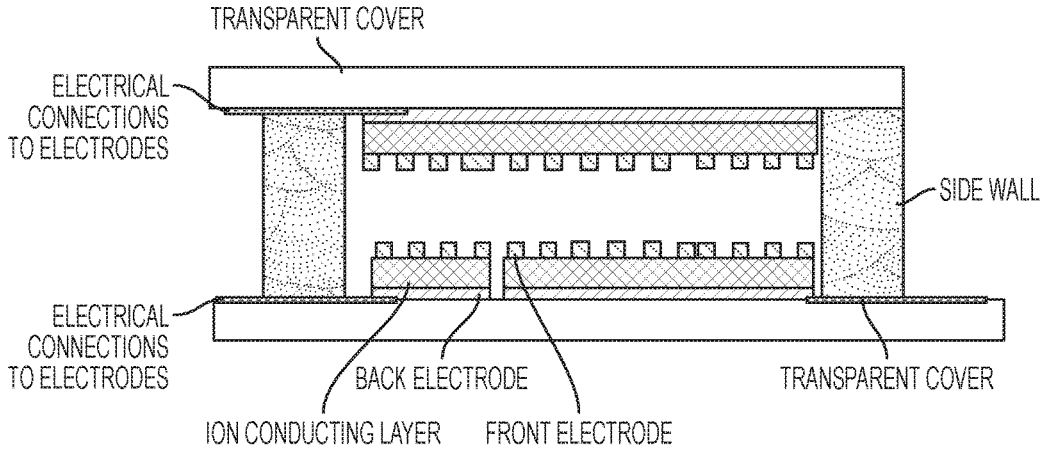
FIG. 9 is a side-view schematic of a chip-scale variation of a transparent alkali source/sink, in some embodiments.

FIG. 9 is a side-view schematic of a chip-scale variation of a transparent alkali source/sink, in some embodiments.

Figure 10:
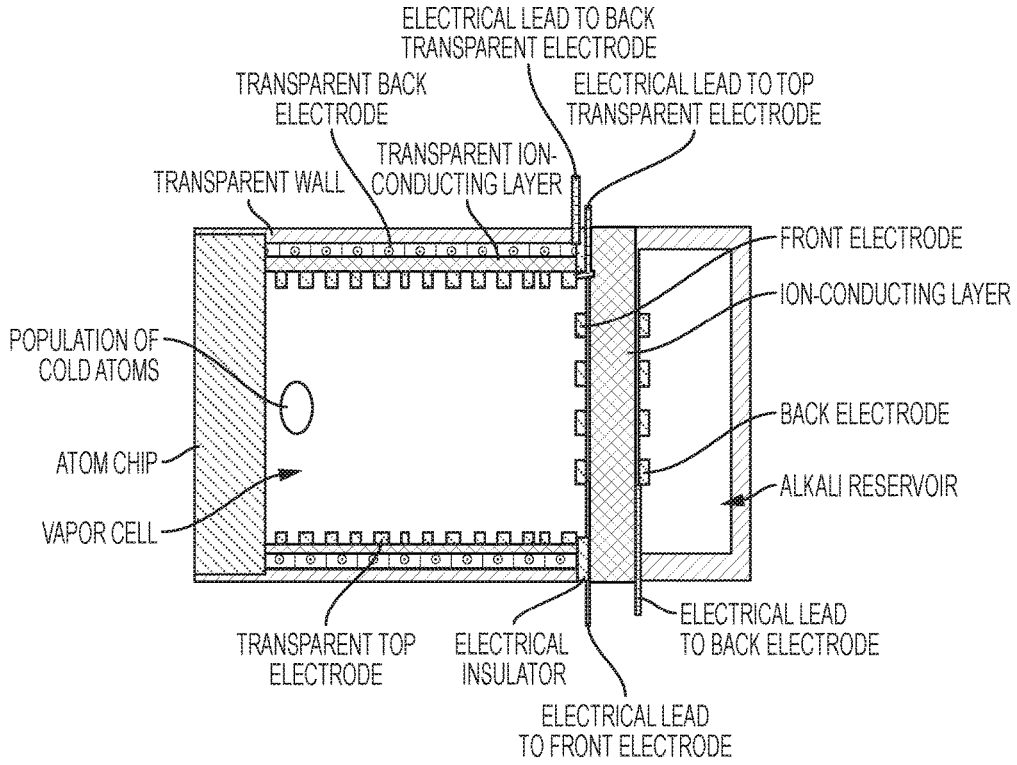
FIG. 10 is a schematic of a transparent alkali source/sink integrated with an atom chip at the package level, in some embodiments.

FIG. 10 is a schematic of a transparent alkali source/sink integrated with an atom chip at the package level, in some embodiments.

Figure 11:
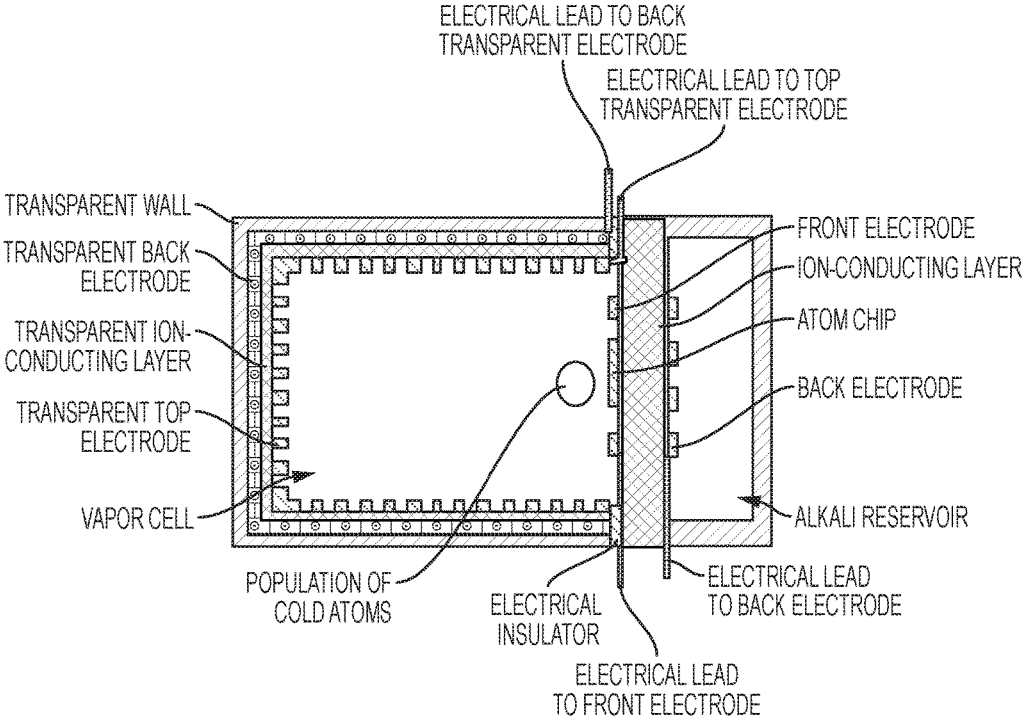
FIG. 11 is a schematic of a transparent alkali source/sink with an atom chip heterogeneously integrated with one of the ion-conducting layers, in some embodiments.

FIG. 11 is a schematic of a transparent alkali source/sink with an atom chip heterogeneously integrated with one of the ion-conducting layers, in some embodiments.

Figure 12:
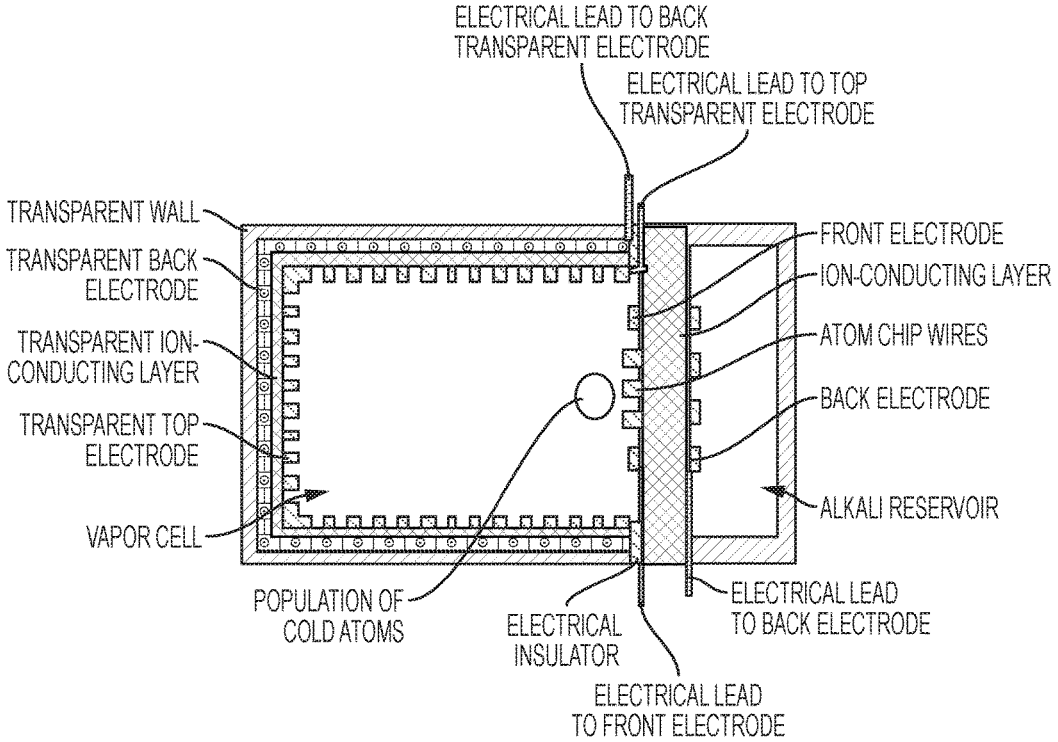
FIG. 12 is a schematic of a transparent alkali source/sink with an atom chip fully integrated with one of the ion-conducting layers.

FIG. 12 is a schematic of a transparent alkali source/sink with an atom chip fully integrated with one of the ion-conducting layers. In this case, the atom chip electrical traces are patterned with the ion-conducting layer as a substrate.

Figure 13:
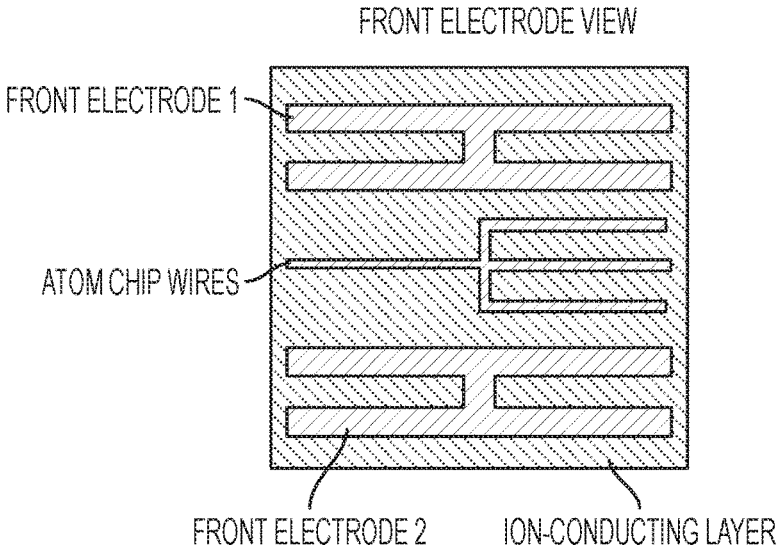
FIG. 13 is a schematic of electrodes and atom chip wires on an ion-conducting layer in a transparent alkali source/sink, with an atom chip fully integrated within the ion-conducting layer.

FIG. 13 is a schematic of electrodes and atom chip wires on an ion-conducting layer in a transparent alkali source/sink, with an atom chip fully integrated within the ion-conducting layer.

Some variations of the invention provide a magneto-optical trap apparatus, the apparatus comprising:

a vapor-cell region configured to allow three orthogonal vapor-cell optical paths into a vapor-cell gas phase within the vapor-cell region;

a first electrode disposed in contact with the vapor-cell region;

a second electrode that is electrically isolated from the first electrode;

a transparent ion-conducting layer interposed between the first electrode and the second electrode, wherein the transparent ion-conducting layer is at least 10% optically transparent over at least a 1 picometer wide optical band of electromagnetic wavelengths;

a source of laser beams configured to provide the three orthogonal vapor-cell optical paths through the vapor-cell gas phase, to trap a population of cold atoms; and a magnetic-field source configured to generate magnetic fields within the vapor-cell region.

Some embodiments provide a magneto-optical trap apparatus, the apparatus comprising:

a vapor-cell region configured to allow three or more vapor-cell optical paths into a vapor-cell gas phase within the vapor-cell region;

a first electrode disposed in contact with the vapor-cell region;

a second electrode that is electrically isolated from the first electrode;

a transparent ion-conducting layer interposed between the first electrode and the second electrode, wherein the transparent ion-conducting layer is at least 10% optically transparent over at least a 1 picometer wide optical band of electromagnetic wavelengths;

a source of laser beams configured to provide the three or more vapor-cell optical paths through the vapor-cell gas phase, in a pyramid configuration, to trap a population of cold atoms; and a magnetic-field source configured to generate magnetic fields within the vapor-cell region.

Some variations of the invention provide an atomic-cloud imaging apparatus, the apparatus comprising:

a vapor-cell region configured to allow three orthogonal vapor-cell optical paths into a vapor-cell gas phase within the vapor-cell region;

a first electrode disposed in contact with the vapor-cell region;

a second electrode that is electrically isolated from the first electrode;

a transparent ion-conducting layer interposed between the first electrode and the second electrode, wherein the transparent ion-conducting layer is at least 10% optically transparent over at least a 1 picometer wide optical band of electromagnetic wavelengths;

a source of laser beams configured to provide the three orthogonal vapor-cell optical paths through the vapor-cell gas phase, to image a population of cold atoms; and a magnetic-field source configured to generate magnetic fields within the vapor-cell region.

Some variations of the invention provide an atomic-cloud imaging apparatus, the apparatus comprising:

a vapor-cell region configured to allow three or more vapor-cell optical paths into a vapor-cell gas phase within the vapor-cell region;

a first electrode disposed in contact with the vapor-cell region;

a second electrode that is electrically isolated from the first electrode;

a transparent ion-conducting layer interposed between the first electrode and the second electrode, wherein the transparent ion-conducting layer is at least 10% optically transparent over at least a 1 picometer wide optical band of electromagnetic wavelengths;

a source of laser beams configured to provide the three or more vapor-cell optical paths through the vapor-cell gas phase, in a pyramid configuration, to image a population of cold atoms; and a magnetic-field source configured to generate magnetic fields within the vapor-cell region.

In some embodiments, vapor cells have independent alkali (or alkaline earth) vapor pressure control. An alkali metal or alkaline earth metal vapor cell may be configured with a solid electrolyte used to transport alkali or alkaline earth atoms between the vapor cell and a reserve reservoir, thus enabling electrical control over alkali or alkaline earth content of the vapor cell. The solid electrolyte can control the alkali or alkaline earth vapor pressure within the vapor cell.

A vapor cell oven enables independent control over the alkali or alkaline earth partial pressure and an optional buffer gas partial pressure in the vapor cell. In some embodiments, the buffer gas partial pressure is controlled by the oven temperature and the alkali or alkaline earth partial pressure is controlled by the voltage and current applied across the solid electrolyte. As conditions in the vapor cell change over time, the oven temperature and alkali or alkaline earth partial pressure can be adjusted to maintain a narrow, stable absorption peak. Because the alkali or alkaline earth concentration may be adjusted after the vapor cell is sealed, precision loading of alkali or alkaline earth metal is not necessary, thus making the sealing process significantly easier.

Variations of this invention enable a miniature vapor cell with a narrow, stable absorption peak. A miniature vapor cell with a narrow, stable absorption peak may be useful for miniature position, navigation, and timing systems, among other uses.

When a reservoir region is present, the reservoir region also contains an alkali metal (e.g. Na, K, Cs, or Rb) and/or an alkaline earth metal (e.g., Be, Mg, Ca, or Sr). The reservoir region and the vapor-cell region preferably contain the same alkali or alkaline earth metal atoms, but that is not necessary.

The reservoir region should be capable of vapor isolation from the vapor-cell region. By "capable of vapor isolation" as intended herein, it is meant that the vapor-cell region and the reservoir region can be configured such that vapor cannot freely flow (by convection or diffusion, referred to herein individually or collectively as "vapor communication") between the vapor-cell region and the reservoir region. In some embodiments, a reservoir region is designed such that it is not ever in vapor communication with the vapor-cell region—unless there is some sort of leak or structural damage to the system. In certain embodiments, a closable valve is placed between the vapor-cell region and the reservoir region. In such embodiments, when the valve is optionally opened, the vapor-cell region and the reservoir region will temporarily be in vapor communication. However, the valve (if present) is normally closed, making the reservoir region in vapor isolation from the vapor-cell region.

In some embodiments, the concentration of the alkali or alkaline earth metal in the reservoir region is greater than that of the vapor-cell region. In these or other embodiments, the volume of the reservoir region is smaller than that of the vapor-cell region. The total number of atoms of alkali or alkaline earth metal in the reservoir region may be larger or smaller than the total number of atoms of alkali or alkaline earth metal in the vapor-cell region. The alkali or alkaline earth metal atoms in the reservoir region are preferably in the vapor phase, but they may also be present in a liquid phase and/or a solid phase contained in the reservoir region.

Walls enclose the reservoir region, sealing it from the ambient environment. The walls may be fabricated from silicon, $SiO_2$, fused silica, quartz, pyrex, metals, dielectrics, or a combination thereof, for example. Optionally, at least one of the walls includes a substantially transparent portion such that there is an optical path through the reservoir region.

A solid electrolyte may be disposed between the vapor-cell region and to the reservoir region. At least two electrodes are generally present in the system. One electrode is connected to the solid electrolyte and to the vapor-cell region. Another electrode is connected to the solid electrolyte and to the reservoir region. The second electrode is electrically isolated from the first electrode. That is, there should not be an electrically conductive path between the two electrodes in the system. Dielectric materials may be employed to isolate and electrically insulate the electrodes from other parts of the system.

The vapor cell may be contained within an oven which can control the temperature of the vapor-cell system. In some embodiments, the vapor-cell region is contained in an oven while the reservoir region is not, or is contained in a different thermal zone.

A second solid electrolyte may be connected between either the vapor cell and the ambient or the reservoir and the ambient. There are two electrodes associated with this second solid electrolyte, one on each side. This second solid electrolyte could be used to load alkali or alkaline earth metal into the vapor-cell region or into the reservoir region. The alkali or alkaline earth loading operation may be done at the beginning of the life of the vapor-cell system. The alkali or alkaline earth loading operation may be repeated periodically through the life of the vapor-cell system. This loading operation is easier than loading a precise amount of alkali or alkaline earth vapor into an unsealed vapor cell and then sealing the vapor cell. An impermeable (or reduced permeability) layer could be placed over the solid electrolyte after loading to eliminate or reduce the diffusion of alkali or alkaline earth vapor out of the vapor-cell region and/or out of the reservoir region.

The system may include one or more heaters to temporarily increase the ionic conductivity of the solid electrolyte. The system may include one or more temperature-measurement devices, such as thin-film resistance temperature detectors. The vapor-cell system temperature may be adjusted in response to the temperature measurement. For example, the system may include a heater to controllably increase ionic conductivity of the solid electrolyte.

The system may include a membrane which deflects as the pressure inside the vapor cell changes. The deflection could be read out with an electrical signal (e.g. piezoelectric, capacitive, differential capacitive, etc.). The membrane could deflect as the pressure between the vapor cell and a reference cell changes. The reference cell may contain vacuum or may contain a substance in vapor-solid or vapor-liquid equilibrium such that the pressure inside the reference cell would be known by knowing the temperature of the reference cell.

The system may be configured to allow a secondary optical path through the reservoir region. Multiple laser beams may be employed, or the beam of a single laser may be split to interrogate both the primary and secondary optical paths. The difference in absorption between the two paths may be used to sense the difference in alkali or alkaline earth vapor pressure between the two chambers. If the alkali or alkaline earth in the reservoir is in a vapor-liquid or solid-vapor equilibrium, then the vapor pressure in the reservoir is known if the temperature of the reservoir is known. Thus, the vapor pressure of the alkali or alkaline earth in the vapor cell can be determined by knowing the difference in absorption between the two optical paths and the temperature of the reservoir.

An "optical path" is the path of a spectroscopic probing beam of light (or other type of laser beam) into the alkali or alkaline earth vapor-cell region, or in some cases, into a reservoir region. The optical path is optional in the sense that the device itself does not inherently include the beam of light, while operation of the device will at least periodically mean that an optical path is traversing into or through the alkali or alkaline earth vapor-cell region. Also note that an optical path is not necessarily a straight line. Internal reflectors may be included in the system, so that optical reflection occurs. In that case, the optical beam could enter and exit along the same wall (detection probe on the same side as the laser source), for example.

In some embodiments, the reservoir alkali or alkaline earth metal is present at a higher molar concentration in the reservoir region than the molar concentration of the vapor-cell alkali or alkaline earth metal in the vapor-cell region. The volume of the reservoir region is typically (but not necessarily) less than the volume of the vapor-cell region.

In some embodiments, the system further comprises an additional solid electrolyte disposed in ionic communication between the vapor-cell region and an external source of alkali or alkaline earth metal, for initial or periodic loading of the vapor-cell region with the vapor-cell alkali or alkaline earth metal. In these or other embodiments, the system may include another solid electrolyte disposed in ionic communication between the reservoir region and an external source of alkali or alkaline earth metal, for initial or periodic loading of the reservoir region with the reservoir alkali or alkaline earth metal.

In some embodiments, the reservoir region is configured to allow a reservoir-region optical path through the reservoir region. The system may be configured to provide a first laser beam directed to the vapor-cell optical path(s) and a second laser beam directed to the reservoir-region optical path. In some of these embodiments, the system includes a first laser source providing the first laser beam, and a second laser source providing the second laser beam. In other embodiments, the system includes a single laser source that is split to the first laser beam and the second laser beam. Some embodiments further include a sensor to detect an absorption difference between the first laser beam and the second laser beam, wherein the absorption difference is correlated to a difference in alkali or alkaline earth vapor pressure between the vapor-cell region and the reservoir region.

The polarity of the voltage may be selected to control direction of alkali or alkaline earth atom flux, either from the reservoir region into the vapor-cell region, or from the vapor-cell region into the reservoir region. The amplitude of the voltage may be selected to control magnitude of alkali or alkaline earth atom flux.

Some variations of the invention provide a method for operation of a vapor-cell system with transparent alkali source, including some or all of the following steps.

A voltage may be applied between the first (front) and second (back) electrodes. In some embodiments, the voltage is applied such the second electrode has a higher electrical potential than the first electrode. This causes mobile ions within the solid electrolyte to conduct towards the first electrode.

At or near a three-phase region of the first electrode, solid electrolyte, and vapor chamber volume, electrons will combine with mobile ions (e.g. $Rb^+$, $Cs^+$, $Na^+$, $K^+$, and/or $Sr^{2+}$) to create neutral atoms (e.g. Rb, Cs, Na, K, and/or Sr). These neutral atoms will then desorb from the surface into the vapor chamber volume, thus increasing the vapor density or vapor pressure in the vapor chamber volume.

There are multiple options for what occurs at the back electrode. If there is a solid source of replacement ions, the replacement ions will enter the ion-conductor near the back electrode and prevent the formation of an ion-depletion region. If there is an ion-blocking electrode, then within the solid electrolyte near the second electrode, a region partially or fully depleted in mobile ions will form. Immobile ions (e.g., Al—O—$^-$ or $O^{2-}$) will remain. These immobile ions will form a pseudocapacitor balanced by the charge on the second electrode. These charges are physically separated.

Alkali ion flow may be reduced and may eventually stop as more and more of the applied voltage drops across the pseudocapacitor region to maintain the charge separation. If there is an alkali reservoir with alkali vapor, then alkali metal atoms or alkaline earth metal atoms will adsorb on the ion conductor and/or on the back electrode. The adsorbed metal ions will ionize, and the resulting alkali or alkaline earth ions will enter the ion conductor and replace the lost ions.

This exemplary method preferably includes one or more of the following additional steps, in some embodiments.

A population of cold atoms (i.e., two or more cold atoms at temperatures of, for example, about 100 μK to 1000 μK) may be prepared within the vapor chamber volume. This population may be formed with a magneto-optical trap (MOT), as described above.

In some embodiments, a voltage is applied between a pair of first and second electrodes to evacuate some or all of the alkali atoms from the vapor cell. If the back (second) electrode is in contact with a reservoir volume, then the polarity of the voltage should be reversed compared to the loading step. Alkali metal atoms or alkaline earth metal atoms from the vapor cell will adsorb onto the front electrode or the front side of the ion conductor, ionize, and then migrate (conduct) into the ion conductor. On the other side of the ion conductor, ions will be neutralized by electrons supplied via the back electrode and desorb (as neutral atoms) from the surface of the ion conductor into the alkali reservoir.

If the back electrode contains a source of replacement ions, then the polarity of the voltage should be reversed compared to the loading step. Ions in the ion conductor (including some of both the original ions and replacement ions) will migrate towards the back electrode, be neutralized at the back electrode by electrons supplied via the back electrode, and exit the ion conductor as neutral atoms.

If the back electrode is an ion-blocking electrode, then the applied voltage may be reduced, brought to zero, or even be reversed in polarity. This voltage reduction causes mobile ions within the solid electrolyte to conduct towards the depleted ion region. Where neutral atoms (e.g. Rb, Cs, Na, K, and/or Sr) from the vapor phase adsorb at or near the three-phase region of the first electrode, solid electrolyte, and vapor chamber volume, neutral atoms will separate into electrons and mobile ions (e.g. $Rb^+$, $Cs^+$, $Na^+$, $K^+$, and/or $Sr^{2+}$). This will reduce the vapor density or vapor pressure in the vapor chamber volume. The mobile ions near the first electrode will conduct into the ion conductor, towards the ion-depleted region.

After reducing the vapor pressure as described above, the trap on the population of cold atoms may be released and a measurement of frequency or position may be made, for example.

In some embodiments, a voltage is applied for a given duration across two electrodes that are situated on opposite sides of a solid electrolyte. This electrical input causes the transport of alkali or alkaline earth atoms from an ambient source into a reservoir region.

The temperature of an oven may be set to control the temperature of the vapor cell at a set-point temperature. The partial pressure of the buffer gas (if present) may be controlled by the set-point temperature. The set-point temperature and the concentration of the alkali or alkaline earth metal in the vapor-cell region may be chosen, in some embodiments, such that all of the alkali or alkaline earth atoms are in the vapor phase (i.e. none are in the liquid phase or solid phase).

A voltage may be applied for a given duration across two electrodes that are situated on opposite sides of a solid electrolyte, to control the partial pressure of the alkali or alkaline earth metal in the vapor cell at a set-point partial pressure. The voltage polarity is selected to control the direction of alkali or alkaline earth atom flux (either from the reservoir into the vapor cell or from the vapor cell into reservoir). The voltage amplitude is selected to control the alkali or alkaline earth atom flux.

The method may include applying an initial or periodic voltage across separate electrodes situated on opposite sides of an additional solid electrolyte, to initially or periodically load the reservoir region with the reservoir alkali metal. Alternatively or additionally, the method may include applying an initial or periodic voltage across separate electrodes situated on opposite sides of an additional solid electrolyte, to initially or periodically load the vapor-cell region with the vapor-cell alkali or alkaline earth metal.

In some embodiments, the reservoir alkali or alkaline earth metal is present at a higher molar concentration in the reservoir region than the molar concentration of the vapor-cell alkali or alkaline earth metal in the vapor-cell region. Optionally, the set-point temperature and concentration of the vapor-cell alkali or alkaline earth metal are selected to ensure atoms of the vapor-cell alkali or alkaline earth metal are essentially in the vapor phase.

If multiple sets of first electrodes, ion conductors, and second electrodes are present, more complex operation modes are enabled. One particularly useful operation mode is as follows, which may be applied to the device in FIG. 6, for example.

A vapor cell is initially sealed in vacuum. A transparent set of electrodes and ion conductor is electrically biased to move some alkali metal into the vapor cell and create a depletion region near the rear loading electrode. This voltage may be maintained. Simultaneously, or sequentially, alkali atoms are loaded into the vapor cell by applying a voltage across an opaque set of electrodes and ion conductor which contains a back electrode with a source of replacement ions. A population of cold atoms is prepared. The voltages on the transparent set of electrodes and ion conductor are reduced to zero to prevent or minimize alkali atoms from desorbing from the walls. Simultaneously, or sequentially, a voltage is applied across an opaque set of electrodes and ion conductor in contact with an alkali reservoir, but without a source of replacement ions to transport alkali ions out of the vapor cell and into the reservoir. The trap on the population of cold atoms may be released and a measurement of frequency or position could be made, for example.

In this detailed description, reference has been made to multiple embodiments and to the accompanying drawings in which are shown by way of illustration specific exemplary embodiments of the invention. These embodiments are described in sufficient detail to enable those skilled in the art to practice the invention, and it is to be understood that modifications to the various disclosed embodiments may be made by a skilled artisan.

Where methods and steps described above indicate certain events occurring in certain order, those of ordinary skill in the art will recognize that the ordering of certain steps may be modified and that such modifications are in accordance with the variations of the invention. Additionally, certain steps may be performed concurrently in a parallel process when possible, as well as performed sequentially.

All publications, patents, and patent applications cited in this specification are herein incorporated by reference in their entirety as if each publication, patent, or patent application were specifically and individually put forth herein.

The embodiments, variations, and figures described above should provide an indication of the utility and versatility of the present invention. Other embodiments that do not provide all of the features and advantages set forth herein may also be utilized, without departing from the spirit and scope of the present invention. Such modifications and variations are considered to be within the scope of the invention defined by the claims.

What is claimed is:

1. A vapor-cell system comprising:

a vapor-cell region configured to allow at least one vapor-cell optical path into a vapor-cell vapor phase within said vapor-cell region;

a first electrode disposed in contact with said vapor-cell region;

a second electrode that is electrically isolated from said first electrode; and a transparent ion-conducting layer interposed between said first electrode and said second electrode, wherein said transparent ion-conducting layer is at least 10% optically transparent over at least a 1 picometer wide optical band of electromagnetic wavelengths.

2. The vapor-cell system of claim 1, wherein said vapor-cell vapor phase contains a vapor-cell alkali metal, alkaline earth metal, or combination thereof.

3. The vapor-cell system of claim 1, wherein said vapor-cell region is hermetically sealed.

4. The vapor-cell system of claim 1, wherein said vapor-cell region is in fluid communication with another system.

5. The vapor-cell system of claim 1, wherein said transparent ion-conducting layer comprises alumina, β-alumina, β"-alumina, yttria-stabilized zirconia, NASICON, LISICON, KSICON, and combinations thereof.

6. The vapor-cell system of claim 1, wherein said transparent ion-conducting layer is ion-exchanged with an ionized version of an alkali metal or alkaline earth metal.

7. The vapor-cell system of claim 1, wherein said transparent ion-conducting layer is ionically conductive for at least one ionic species selected from the group consisting of $Rb^+$, $Cs^+$, $Na^+$, $K^+$, and $Sr^{2+}$.

8. The vapor-cell system of claim 1, wherein said transparent ion-conducting layer is characterized by an ionic conductivity at 25° C. of about $10^{-7}$ S/cm or higher.

9. The vapor-cell system of claim 1, wherein said optical band is within ultraviolet, visible, and/or infrared bands.

10. The vapor-cell system of claim 1, wherein said optical band is at least 10 picometers wide.

11. The vapor-cell system of claim 1, wherein said optical band includes an unperturbed optical transition of an alkali atom or alkaline earth atom.

12. The vapor-cell system of claim 1, wherein said transparent ion-conducting layer is at least 50% optically transparent over said optical band.

13. The vapor-cell system of claim 1, wherein said first electrode is at least 10% optically transparent over said optical band.

14. The vapor-cell system of claim 1, wherein said first electrode is fabricated from a material selected from the group consisting of indium tin oxide, antimony tin oxide, zinc tin oxide, and combinations thereof.

15. The vapor-cell system of claim 1, wherein said first electrode is fabricated from metallic microwires, metallic nanowires, or metallic lithographically patterned networks.

16. The vapor-cell system of claim 1, wherein said first electrode is fabricated from a graphene single layer, a graphene multi-layer, or a combination thereof.

17. The vapor-cell system of claim 1, wherein said second electrode is at least 10% optically transparent over said optical band.

18. The vapor-cell system of claim 1, wherein said second electrode is fabricated from a material selected from the group consisting of indium tin oxide, antimony tin oxide, zinc tin oxide, and combinations thereof.

19. The vapor-cell system of claim 1, wherein said second electrode is fabricated from metallic microwires, metallic nanowires, or metallic lithographically patterned networks.

20. The vapor-cell system of claim 1, wherein said second electrode is fabricated from a graphene single layer, a graphene multi-layer, or a combination thereof.

21. The vapor-cell system of claim 1, wherein said second electrode is not in contact with said vapor-cell region.

22. The vapor-cell system of claim 1, wherein said second electrode is porous.

23. The vapor-cell system of claim 1, said system further comprising an atom chip.

24. The vapor-cell system of claim 1, wherein said vapor-cell system is configured to allow three vapor-cell optical paths into said vapor-cell vapor phase.

25. A magneto-optical trap apparatus, said apparatus comprising:

a vapor-cell region configured to allow three orthogonal vapor-cell optical paths into a vapor-cell gas phase within said vapor-cell region;

a first electrode disposed in contact with said vapor-cell region;

a second electrode that is electrically isolated from said first electrode;

a transparent ion-conducting layer interposed between said first electrode and said second electrode, wherein said transparent ion-conducting layer is at least 10% optically transparent over at least a 1 picometer wide optical band of electromagnetic wavelengths;

a source of laser beams configured to provide said three orthogonal vapor-cell optical paths through said vapor-cell gas phase, to trap a population of cold atoms; and a magnetic-field source configured to generate magnetic fields within said vapor-cell region.

26. An atomic-cloud imaging apparatus, said apparatus comprising:

a vapor-cell region configured to allow three orthogonal vapor-cell optical paths into a vapor-cell gas phase within said vapor-cell region;

a first electrode disposed in contact with said vapor-cell region;

a second electrode that is electrically isolated from said first electrode;

a transparent ion-conducting layer interposed between said first electrode and said second electrode, wherein said transparent ion-conducting layer is at least 10% optically transparent over at least a 1 picometer wide optical band of electromagnetic wavelengths;

a source of laser beams configured to provide said three orthogonal vapor-cell optical paths through said vapor-cell gas phase, to image a population of cold atoms; and a magnetic-field source configured to generate magnetic fields within said vapor-cell region.

* * * * *